US008041285B2

(12) United States Patent
Hashimoto et al.

(10) Patent No.: US 8,041,285 B2
(45) Date of Patent: Oct. 18, 2011

(54) MOVING MEMBER HOLDING MECHANISM, PAPER FEEDING DEVICE, AND IMAGE FORMING APPARATUS

(75) Inventors: Susumu Hashimoto, Katsuragi (JP); Toshiki Ohgita, Nara (JP); Hidetoshi Kaneko, Yamatokoriyama (JP); Masayuki Nagatani, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 1008 days.

(21) Appl. No.: 11/851,626

(22) Filed: Sep. 7, 2007

(65) Prior Publication Data

US 2008/0061496 A1 Mar. 13, 2008

(30) Foreign Application Priority Data

Sep. 11, 2006 (JP) ..... 2006-245768

(51) Int. Cl.
*G03G 15/00* (2006.01)

(52) U.S. Cl. ..... 399/379; 399/388; 271/157; 271/162; 271/213

(58) Field of Classification Search ..... 399/379, 399/388; 271/157, 161, 162, 213
See application file for complete search history.

(56) References Cited

U.S. PATENT DOCUMENTS

| | | | | |
|---|---|---|---|---|
| 4,664,507 | A * | 5/1987 | Fukae et al. | 347/138 |
| 5,157,448 | A * | 10/1992 | Lang | 399/23 |
| 6,592,118 | B2 * | 7/2003 | Youn | 271/147 |
| 7,029,006 | B2 * | 4/2006 | Izumi et al. | 271/145 |
| 7,147,218 | B2 * | 12/2006 | Izumi et al. | 271/145 |

FOREIGN PATENT DOCUMENTS

| | | |
|---|---|---|
| CN | 2663381 | 12/2004 |
| JP | 04-322548 | 11/1992 |
| JP | 11-064999 | 3/1999 |

OTHER PUBLICATIONS

Chinese Office Action for corresponding Application No. 200710148775.3 dated Feb. 27, 2009 (with translation).

* cited by examiner

*Primary Examiner* — Matthew G Marini
(74) *Attorney, Agent, or Firm* — Renner, Otto, Boisselle & Sklar, LLP

(57) ABSTRACT

A paper feeding device includes a stacking plate for stacking sheets. The stacking plate is movable vertically within a range from a lower limit position to a pick-up position. The stacking plate has a first surface facing the lower limit position and a second surface facing the pick-up position. The paper feeding device also includes a driving device for driving the stacking plate. The paper feeding device has a locking member for locking the staking plate in the lower limit position. The locking member has a deformable section for contact with the second surface of the stacking plate. The deformable section becomes deformed by a driving force applied through the stacking plate as locked in the lower limit position by the driving device, to unlock the stacking plate.

12 Claims, 17 Drawing Sheets

FIG.8

| DEFORMABLE SECTION | | RESULT OF WHETHER THE DEFORMABLE SECTION COMES OUT OF CONTACT WITH THE STACKING PLATE | | RESULT OF DROP EXPERIMENT | LEVEL OF NOISE PRODUCED | OVERALL JUDGMENT |
|---|---|---|---|---|---|---|
| MATERIAL | THICKNESS | LOAD | RESULT OF JUDGMENT | | | |
| NYLON WASHER | 1.0mm | 7～18kgf | NG | OK | NG (HIGH) | NG |
| HEAVY PAPER PASTED TO RUBBER SHEET | 0.5mm | 7～8kgf | OK | NG(UNLOCKED AFTER DROPPED ONCE ) | OK (LOW) | NG |
| CARDBOARD | 8.0mm | 16～18kgf | NG | OK | OK (MEDIUM) | NG |
| CARDBOARD | 3.0mm | 12～14kgf | OK | OK | OK (MEDIUM) | OK |
| HARDBOARD | 1.0mm | 12～14kgf | OK | OK | OK (MEDIUM) | OK |
| COATED HEAVY PAPER | 0.5mm | 14～15kgf | OK | OK | OK | OK |

MOVING MEMBER HOLDING MECHANISM, PAPER FEEDING DEVICE, AND IMAGE FORMING APPARATUS

CROSS REFERENCE

This Nonprovisional application claims priority under 35 U.S.C. §119(a) on Patent Application No. 2006-245768 filed in Japan on Sep. 11, 2006, the entire contents of which are hereby incorporated by reference.

BACKGROUND OF THE INVENTION

The invention relates to a moving member holding mechanism for locking moving members, such as sheet stacking plates, installed in paper feeding devices provided in image forming apparatus, while the apparatus is being transported. The invention further relates to a paper feeding device that has the moving member holding mechanism and to an image forming apparatus that includes the moving member holding mechanism.

An image forming apparatus forms an image on a sheet such as of paper or OHP film. The apparatus includes an image reading section, an image forming section, and a paper feeding section (hereinafter also referred to as a paper feeding device). The image reading section has a scanning unit. The scanning unit scans an image-bearing side of an original document placed on an original platen, to read image information from the document. The paper feeding section has a stacking plate for stacking sheets. The stacking plate is movable up and down within a predetermined range. The paper feeding section also has a driving section for raising the stacking plate to place the stacked sheets in a pick-up position. The sheets are fed, one by one, to the image forming section. The image forming section forms an image on a fed sheet according to the image information read by the image reading section.

While the apparatus is being transported, its positional changes or vibrations may cause moving members, such as the scanning unit and the stacking plate, to collide with other component members and be damaged. To avoid such potential damage, the moving members are locked with locking members, such as screws or pins, during transport of the apparatus. The locking members are to be removed from the apparatus after the apparatus is placed at an installation site. In the condition, the moving members are rendered movable in the apparatus.

If the locking members fail to be removed before using the apparatus, supply of a driving force to the moving members may cause damage to the apparatus, a break in power supply circuit, or the like. As a solution to the problem, JP H11-064999A discloses an image forming apparatus in which a sealing member is stretched over an exterior pressure plate (a document holder plate) and connected at both ends to locking members. The sealing member prevents opening of the pressure plate. The pressure plate can be opened, and an original document can be read, only after the sealing member is removed. Thus, the locking members never fail to be removed.

The conventional apparatus however necessitates a user removing the locking members. Also, the use of the sealing member limits the position of the locking members.

In view of the foregoing, a feature of the invention is to provide: a moving member holding mechanism that has a locking member which can be arranged at an unlimited position and that is capable of driving a moving member in a normal manner, without damage to the moving member or a driving device, even when the locking member fails to be removed; a paper feeding device having the moving member holding mechanism; and an image forming device including the moving member holding mechanism.

SUMMARY OF THE INVENTION

A moving member holding mechanism according to an aspect of the invention includes a moving member, a driving device, and a locking member. The moving member is movable within a range. The driving device drives the moving member. The locking member locks the moving member in a predetermined position within the movable range by contact with the moving member. The locking member has a deformable section. The deformable section becomes deformed by a driving force applied, through the moving member as locked in the predetermined position, by the driving device. The locking member is brought out of contact with the moving member as locked in the predetermined position by the deformation of the deformable section.

A paper feeding device according to another aspect of the invention includes a stacking plate, a driving device, a locking member, and a pick-up section. The stacking plate is provided for stacking sheets. The stacking plate is movable vertically between a lower limit position and a pick-up position. The driving device drives the stacking plate. The locking member locks the staking plate in the lower limit position by contact with the stacking plate. The pick-up section outputs sheets stacked on the stacking plate from the pick-up position. The locking member has a deformable section. The deformable section is brought into contact with a surface, facing the pick-up position, of the stacking plate as locked in the lower limit position. The deformable section becomes deformed by a driving force applied through the stacking plate as locked in the lower limit position by the driving device. The locking member is brought out of contact with the stacking plate as locked in the lower limit position by the deformation of the deformable section.

An image forming apparatus according to another aspect of the invention includes a base, a driving device, a locking member, an image reading section, a paper feeding device, and an image forming section. The base is provided for reflecting a light beam for reading an image of an original document. The base is movable horizontally between a first end and a second end. The driving device drives the base. The locking member locks the base at the first end by contact with the base. The image reading section reads the image from the light beam as reflected by the base. The paper feeding device feeds sheets stored therein from a pick-up position. The image forming section forms an image on a sheet fed from the paper feeding device based on the image read by the image reading section. The locking member has a deformable section. The deformable section is brought into contact with a surface, facing the second end, of the base as locked at the first end. The deformable section becomes deformed by a driving force applied, through the base as locked at the first end, by the driving device. The locking member is brought out of contact with the base as locked at the first end by the deformation of the deformable section.

BRIEF DESCRIPTION OF THE DRAWINGS

FIG. 8 is a table showing results of experiments carried out to check how the stacker plate is locked by a deformable member of a locking member provided in the LCC, where the material and thickness of the deformable member was varied;

DETAILED DESCRIPTION OF THE INVENTION

An example of image forming apparatus will be described below.

Figure 1:
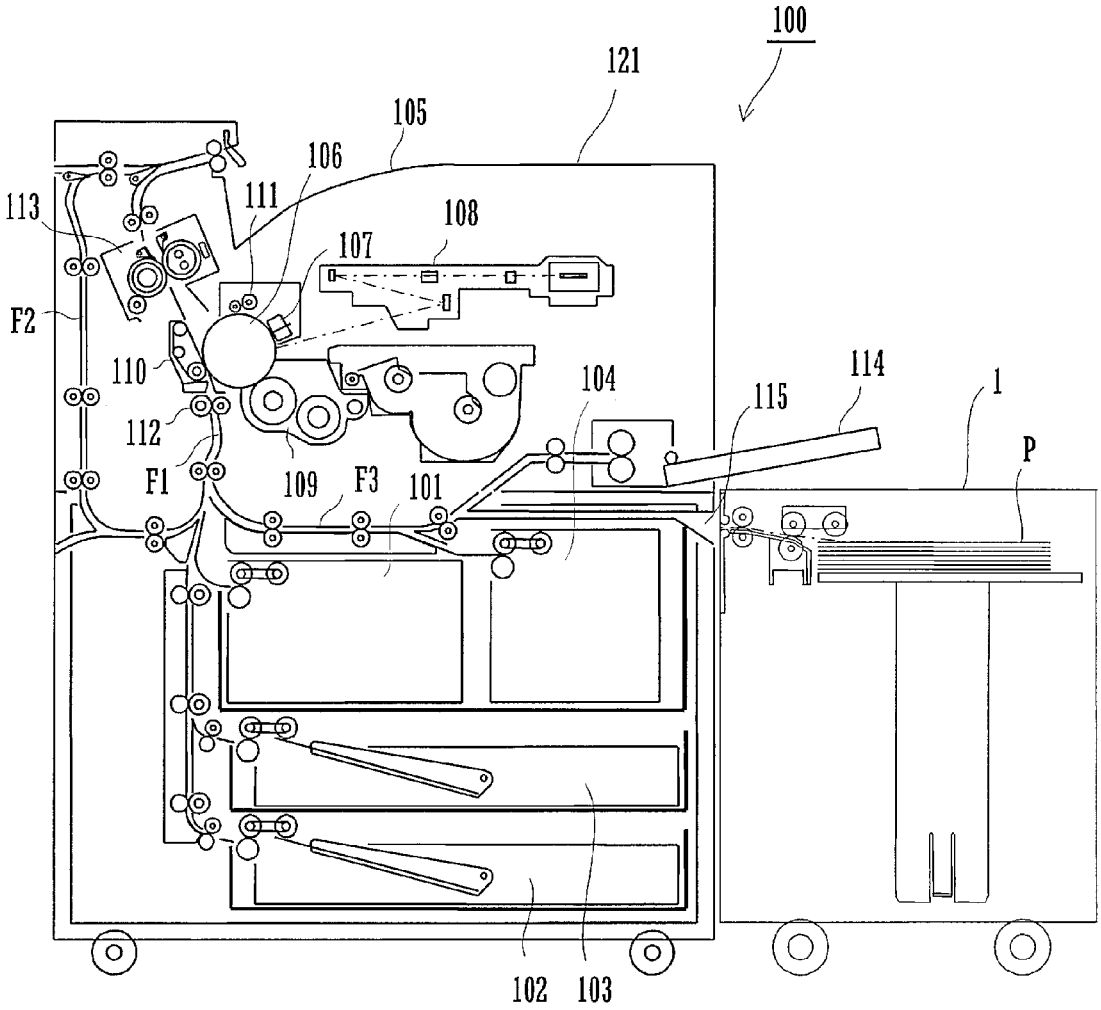
FIG. 1 is a schematic cross-sectional view of an example of a processing apparatus.

FIG. 1 is a schematic cross-sectional view of a processing apparatus 100. The apparatus 100 includes an image forming device 121 and a large capacity cassette (hereinafter merely referred to as LCC) 1. The LCC 1 is installed beside the device 121. The LCC 1 corresponds to the paper feeding device of the Claims. The LCC 1 feeds a sheet of paper P, or another material such as OHP film, into the device 121. The device 121 forms an image on a fed sheet by performing an electrophotographic image forming process. Alternatively, the LCC 1 may be integrated with the device 121. Instead of the single LCC 1, a plurality of LCCs may be arranged in alignment with one another.

The device 121 has paper cassettes 101 to 104 and a paper output tray 105 in a bottom portion and a top portion thereof, respectively. A paper transport path F1 is provided so as to lead from the cassettes 101 to 103 to the tray 105. A photoreceptor drum 106 is positioned along the path F1. Around the drum 106 arranged are a charging device 107, an optical scanning unit 108, a developing unit 109, a transferring device 110, a cleaning unit 111, and the like. Paper stopping rollers 112 are provided upstream of the drum 106 along the path F1. A fusing device 113 is provided downstream of the drum 106 along the path F1.

The rollers 112 feed a sheet of paper P in synchronization with rotation of the drum 106. The device 107 charges a circumferential surface of the drum 106 to a predetermined potential. The unit 108 forms an electrostatic latent image on the circumferential surface of the drum 106 according to external input image data. The unit 109 supplies toner to the circumferential surface and develops the electrostatic latent image into a toner image. The device 110 transfers the toner image from the circumferential surface to a sheet of paper P. Then, the device 113 fuses and fixes the toner image onto the sheet. The sheet with the fixed toner image is output to the tray 105. The unit 111 removes and collects toner debris that remains on the circumferential surface after the transfer of toner image.

The device 121 is also provided with a reversing transport path F2 and a paper transport path F3. In a duplex image forming process in which an image is formed on each side of a sheet of paper P, the path F2 is used to reverse a first and a second sides of the sheet, after an image is formed on the first side, and then transport the sheet to an upstream point of the rollers 112. The path F3, which extends approximately horizontally, is used to feed a sheet of paper P from any one of a manual feeding tray 114, a paper receiving section 115, and the LCC 1 to an upstream point of the rollers 112.

Figure 2:
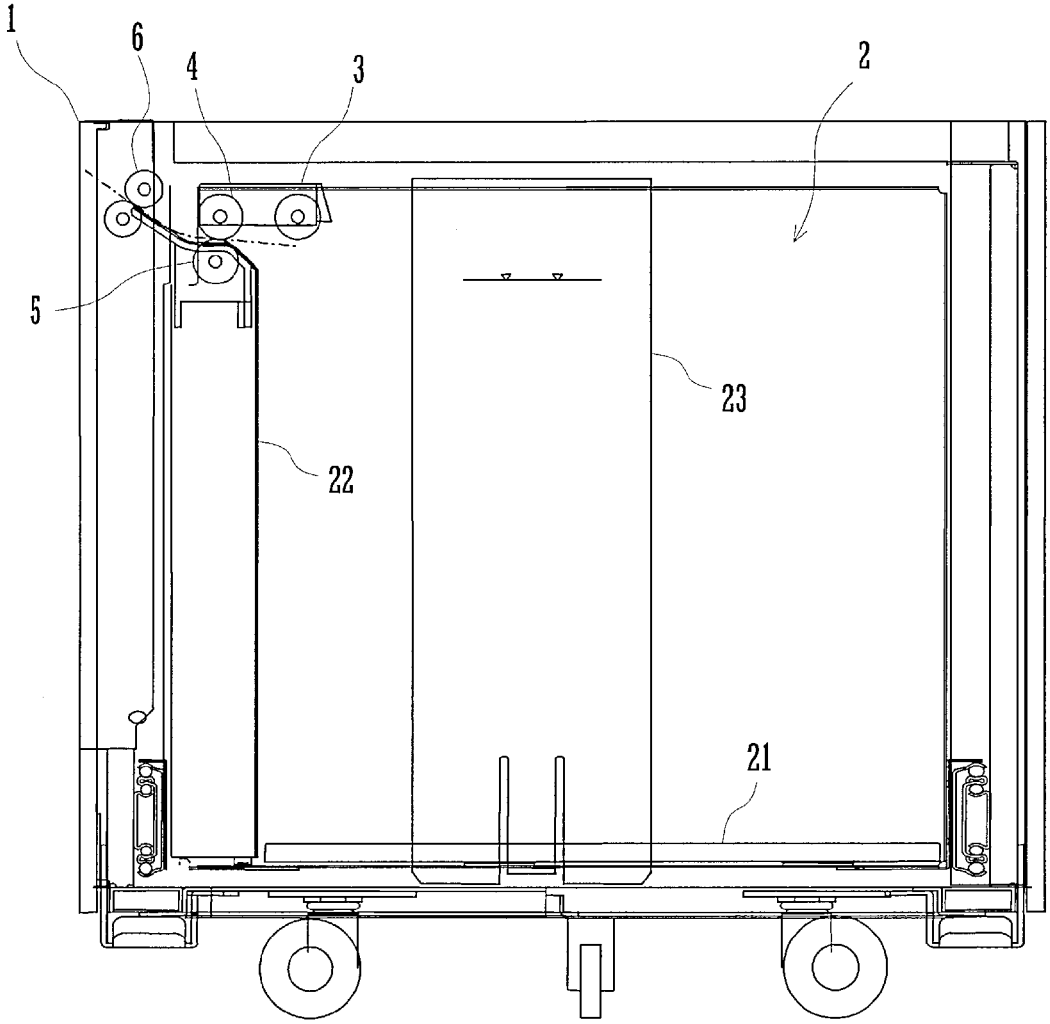
FIG. 2 is a schematic cross-sectional view of a front portion of an LCC 1 provided in the apparatus.

FIG. 2 is a schematic cross-sectional view of a front portion of the LCC 1. The LCC 1 includes a paper stacker 2, a pick-up roller 3, a feeding roller 4, a reversing roller 5, transporting rollers 6, and a moving member holding mechanism (not shown). The roller 3 corresponds to the pick-up section of the Claims.

The stacker 2 has a capacity of a large number of sheets (approximately 4,000 sheets in the present embodiment) of paper P of various sizes such as of A3, B4, A4, and B5.

The stacker 2 has a stacking plate 21, a front guiding plate 22, side guiding plates 23 and 24, and a rear guiding plate. The plate 24 and the rear guiding plate are not shown in the figure. The plate 21 corresponds to the moving member of the Claims. While being held in a horizontal position, the plate 21 is vertically movable within a predetermined range inside the stacker 2. A plurality of sheets of paper P are neatly stacked on the plate 21 by being positioned with the front guiding plate 22, the side guiding plates 23 and 24, and the rear guiding plate.

The roller 3 is supported such that the roller 3 can be pivoted up and down about a rotary shaft of the feeding roller 4 within a predetermined range (a pick-up position). The roller 3 is pivoted, brought into contact with a top one of sheets stacked on the plate 21, and rotated to guide the top sheet between the feeding roller 4 and the reversing roller 5. In a case where multiple sheets are picked up at a time and led between the rollers 4 and 5 by the roller 3, only a top sheet is brought into contact with the roller 4 and led to the transporting rollers 6. The rest of the sheets are returned to the plate 21 by the roller 5.

Figure 3:
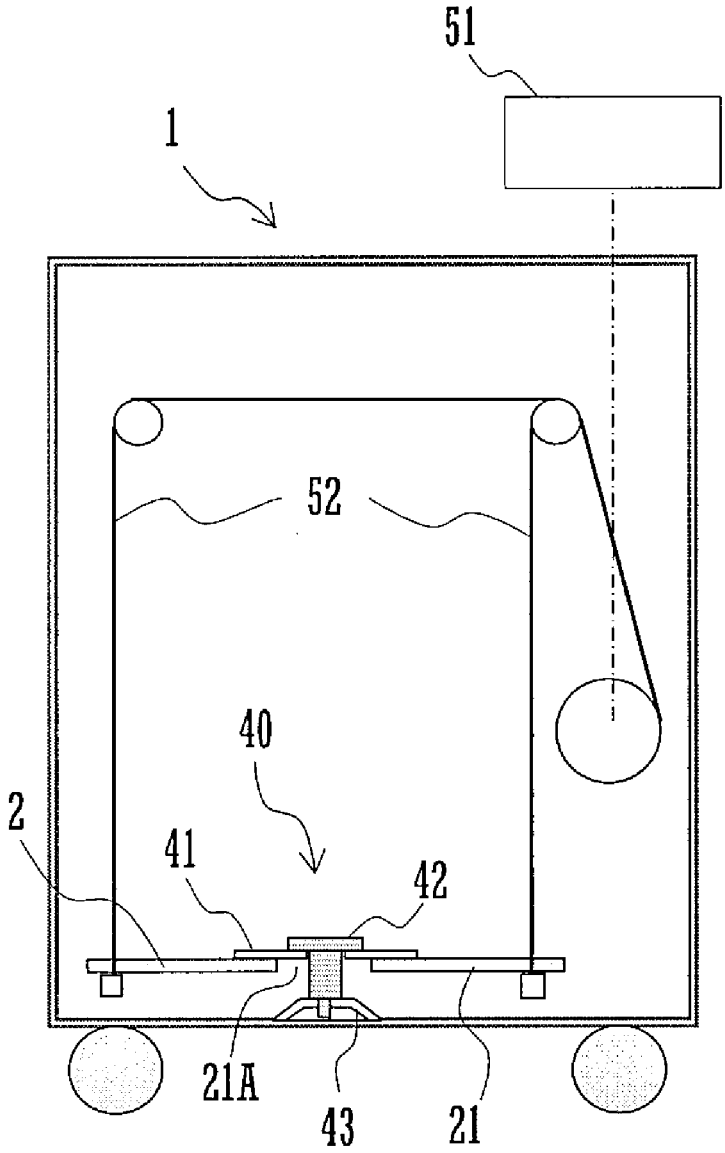
FIG. 3 is a drawing illustrating a locked state of a stacking plate provided in the LCC.

FIG. 3 is a drawing illustrating a locked state of the plate 21. At the bottom of a casing thereof, the LCC 1 has a moving member holding mechanism 40 set at the factory.

A lifting motor 51 is provided at the rear of the stacker 2. The motor 51 corresponds to the driving device of the Claims. A driving force generated by rotation of the motor 51 is transmitted to the plate 21 through a wire 52, so that the plate 21 is moved up and down along a guide shaft (not shown) while being held in a horizontal position. A movable range of the plate 21 extends from a position as shown in the figure, i.e., a lower limit position, to the pick-up position. In the example, the lower limit position corresponds to the locked position of the Claims.

The mechanism 40 has a deformable section 41 and a screw 42. The mechanism 40 prevents movement of the plate 21 during transport of the LCC 1. The section 41 and the screw 42 correctively correspond to the locking member of the Claims. The head of the screw 42 corresponds to the securing section of the Claims, and the shank and the engaging part of the screw 42 correctively correspond to the supporting section of the Claims.

The thread groove of the screw 42 is engaged with a plate member 43. The member 43 is attached to the bottom of the casing of the LCC 1. The deformable section 41 is in the shape of a ring. When the plate 21 is in the locked state, the section 41 has the shank of the screw 42 passed through an opening in the middle, and is nipped (held) by the plate 21 and the head of the screw 42. Being in the lower limit position prevents the plate 21 from moving further downward. Also, the section 41 prevents the plate 21 from moving upward. Moreover, friction with the section 41 prevents the plate 21 from moving horizontally. In the lower limit position, thus, the plate 21 is locked by the section 41. Accordingly, the plate 21 is prevented from being moved and damaged, or being displaced, due to a potential positional change or vibration of the LCC 1.

After the LCC 1 is placed at an installation site, a user takes the screw 42 out of the member 43 before using the LCC 1 in order to remove the mechanism 40, i.e., the screw 42 and the member 43, out of the casing of the LCC 1, so that the plate 21 can be moved up and down freely within the movable range.

If a user forgets to remove the mechanism 40 before using the LCC 1, a driving force generated by rotation of the motor 51 is exerted on the plate 21 to move the plate 21 upward. Through the plate 21, the driving force is also exerted on the section 41, so that the section 41 becomes deformed and released from the head of the screw 42.

Figure 4:
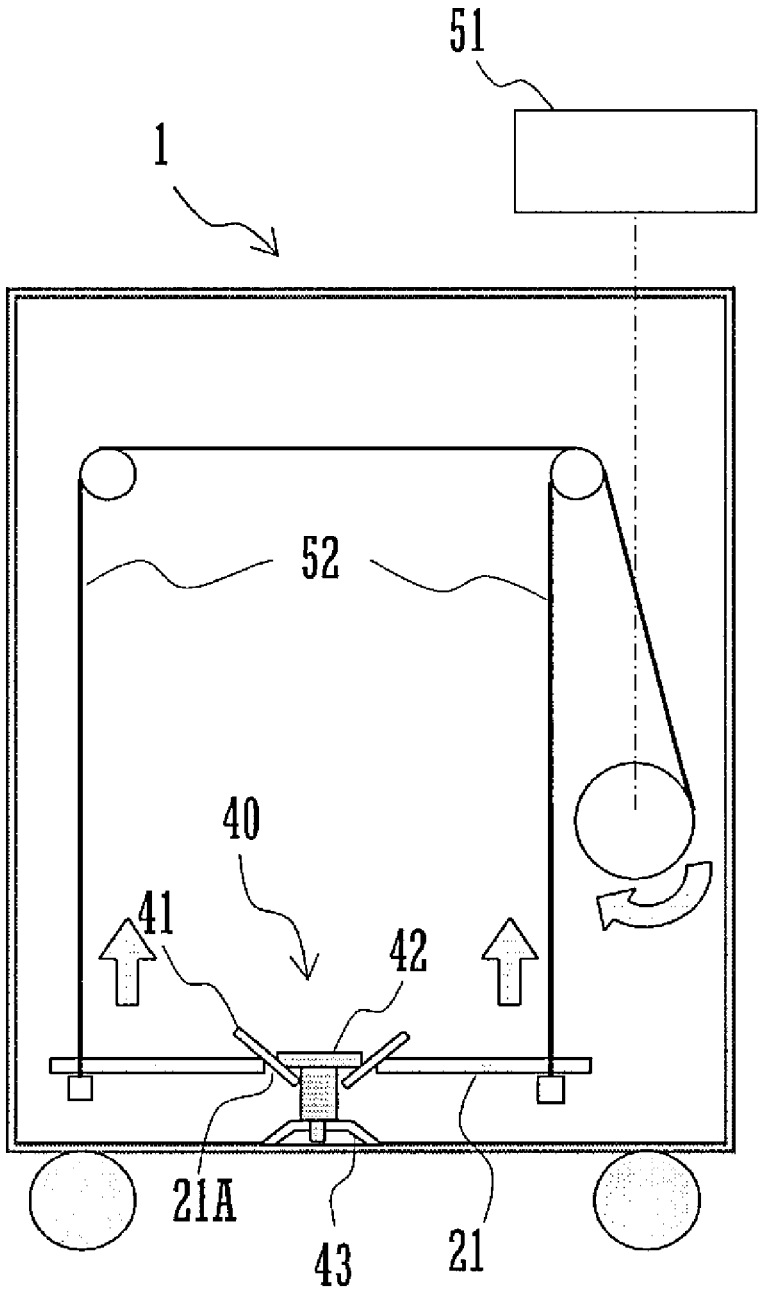
FIG. 4 is a drawing illustrating an unlocked state of the stacking plate.

FIG. 4 is a drawing illustrating an unlocked state of the plate 21. When deformed, the section 41 is released from the head of the screw 42, so that the plate 21 becomes unlocked and upwardly movable. In this state, the screw 42 is positioned in an opening 21A of the plate 21 and out of contact with the plate 21, and therefore does not prevent movement of the plate 21.

Thus, the plate 21 is moved upward by the motor 51, and the section 41 deformed is retracted into a gap between the plate 21 and the screw 42 to drop through the opening 21A.

Figure 5:
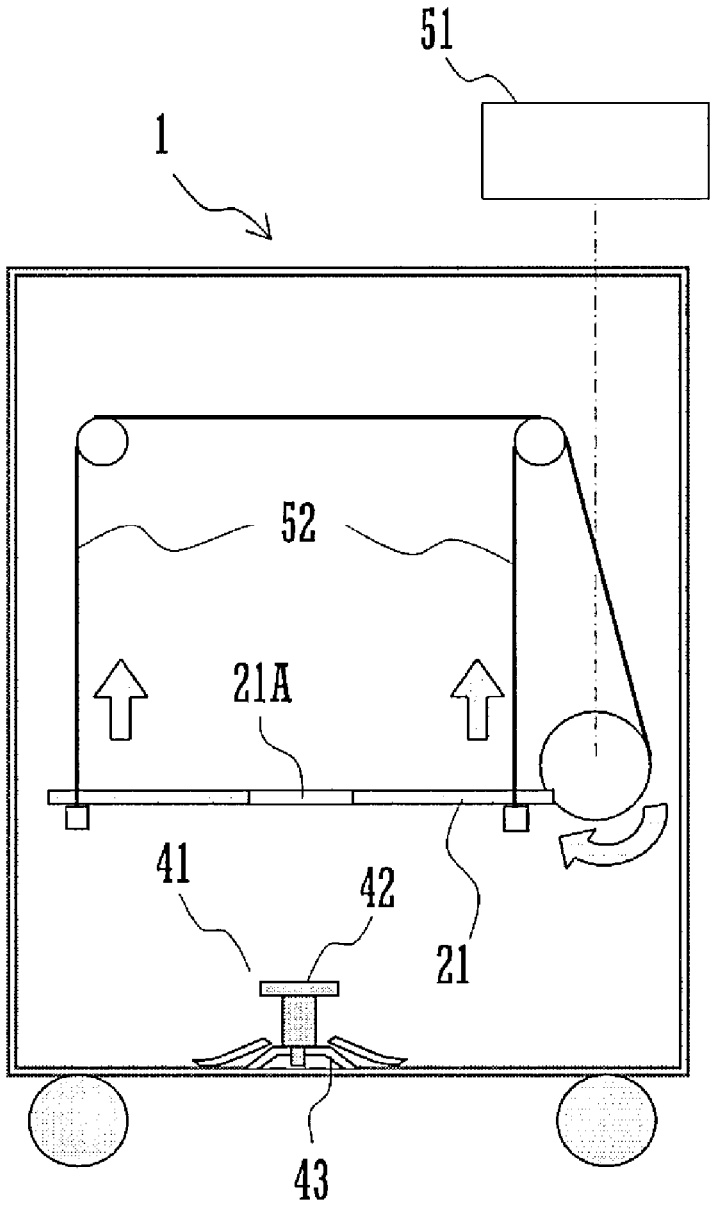
FIG. 5 is a drawing illustrating movement of the stacking plate.

FIG. 5 is a drawing illustrating movement of the plate 21. When the plate 21 moved upward, as described above, the section 41 becomes released from the head of the screw 42 and drops to the bottom of the casing of the LCC 1. This arrangement allows the plate 21 to be moved up and down normally without being damaged or damaging other component elements, even when the mechanism 40 fails to be removed.

Figure 6:
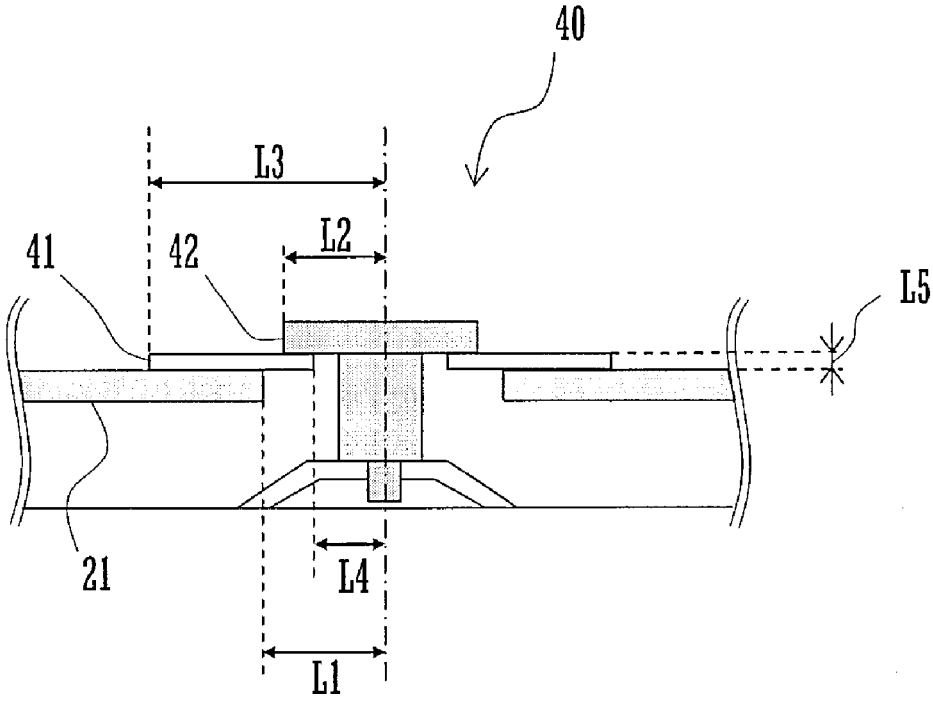
FIG. 6 is a drawing illustrating dimensions of a moving member holding mechanism provided in the LCC.

FIG. 6 is a drawing illustrating dimensions of the mechanism 40.

For the mechanism 40, the following relationship holds:

$$L4<L2<L1<L3,$$

where: L1 is a distance between an axis of the screw 42 and an end of a portion of the plate 21 to have contact with the section 41; L2 is a distance between the axis and an end of the head of the screw 42; L3 is a distance between the axis and an end of the section 41 farthest from the center of the screw 42; and L4 is a distance between the axis and an end of the section 41 nearest to the center of the screw 42. Therefore, the presence of the section 41 ensures that the plate 21 is locked by the mechanism 40.

Further, the following relationship holds:

$$L1>L2+L5,$$

where L5 is thickness of the section 41. In other words, the section 41 is formed in such a manner that its thickness is smaller than the length of the gap between the plate 21 and the screw 42. This allows the section 41 as deformed to pass through the gap and drop to the bottom of the casing of the LCC 1. When returned to the lower limit position, thus, the plate 21 is prevented from being locked again since the section 41 is already released from the screw 42.

In the example, the opening 21A is formed approximately in the horizontal center of the plate 21 in order for an uniform driving force to be exerted on the ring-shaped section 41 in contact with the plate 21. However, it is to be noted that the opening 21A does not necessarily have to be formed in the horizontal center of the plate 21.

Figure 7:
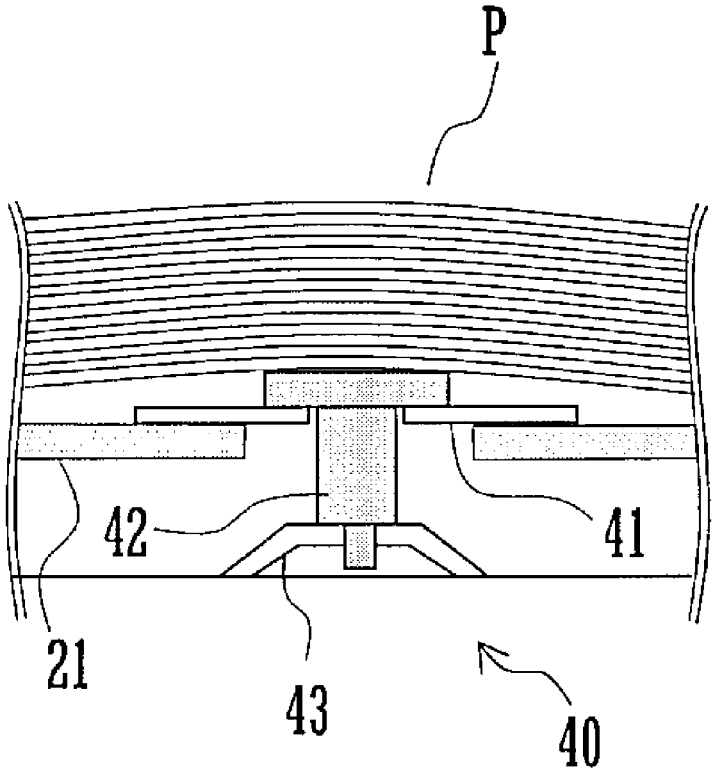
FIG. 7 is a drawing illustrating sheets stored in the LCC.

FIG. 7 is a drawing illustrating sheets of paper P stacked on the plate 21 and the mechanism 40. In this example, the sheets of paper P on the plate 21 are pushed upward by the head of the screw 42. In order to prevent the situation, a depression to be described later may be provided.

The material of the section 41 is not limited to specific ones, but includes anything that allows the section 41 to become deformed, and be brought out of contact with the plate 21, when the driving force of the motor 51 is exerted thereon. The inventors carried out some experiments where the inventors varied the material and thickness of the section 41, to check how the plate 21 is locked by the section 41.

FIG. 8 is a table showing the results of the experiments. In the experiments, the inventors checked how the section 41 of varied materials and thicknesses came out of contact with the plate 21 and how the plate 21 was locked by the section 41. The plate 21 used in the experiments does not become deformed under a load of 20 kgf or less, and the opening 21A has a diameter of 14.5 mm.

In the experiments to check how the section 41 came out of contact with the plate 21, the driving force was applied to the plate 21 to move up the plate 21 without removing the mechanism 40. Judgment was made by visually checking whether the section 41 became released from the head of the screw 42 and came out of contact with the plate 21. To provide an adequate margin of safety, the driving force was applied to the plate 21 in such a manner that load imposed on the plate 21 would be 18 kgf or less. At the same time, a noise produced when the section 41 was to be brought out of contact with the plate 21 was heard.

The results were as shown in the figure. The section 41 as a nylon washer did not come out of contact with the plate 21, even when such a driving force was applied to the plate 21 as to impose a load of 18 kgf thereon, and a high level of noise was produced when the section 41 was released from the head of the screw 42. The section 41 made of cardboard and having the thickness L5 of 8.0 mm did not come out of contact with the plate 21, even when such a driving force was applied to the plate 21 as to impose a load of 18 kgf thereon, though a high level of noise was not produced when the section 41 was released from the head of the screw 42. The section 41 made of the other materials shown in the figure came out of contact with the plate 21, and a noise producing level was not so high when the section 41 was released from the head of the screw 42.

The experiments to check how the plate 21 was locked by the section 41 were conducted by dropping the LCC 1 from a height of 50 cm three times. Judgment was made by visually checking whether the plate 21 came unlocked from the mechanism 40.

The results were as shown in the figure. The plate 21 came unlocked from the section 41 made of heavy paper pasted to a rubber sheet after the LCC 1 was dropped once. The plate 21 did not come unlocked from the section 41 made of the other materials.

It is to be noted that hardboard as shown in the figure is made of a plurality of sheets of heavy paper pasted together and that coated heavy paper is made of common heavy paper with gloss white quality paper pasted to a surface for printing.

Also, the respective shapes of the section 41 and the plate 21 include, but are not limited to, those of a ring and a flat plate disclosed in the example as described above. Now, the mechanism 40 according to other embodiments of the invention will be described below. Elements corresponding to those identified with respect to the mechanism 40 are identified by the same reference numerals, and a detailed description of the common elements will be omitted herein for the sake of brevity.

Figure 9:
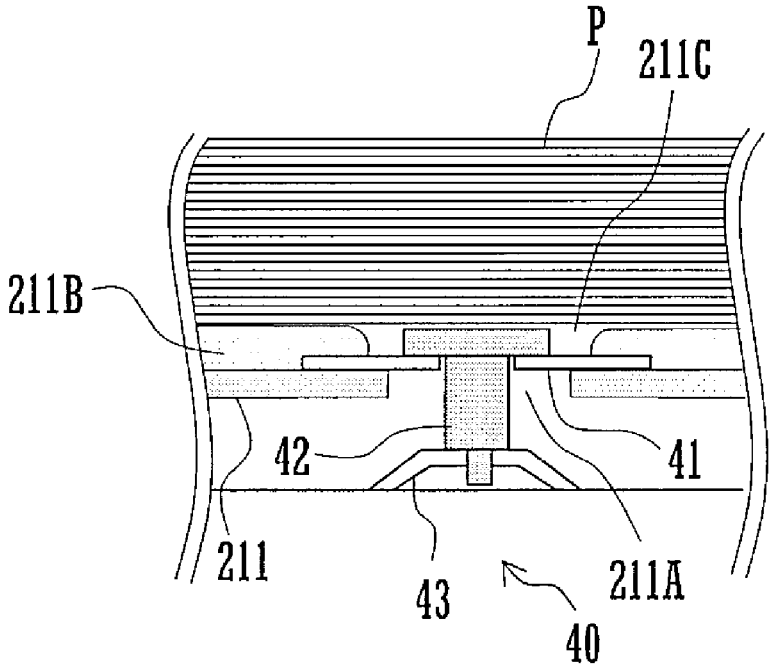
FIG. 9 is a drawing illustrating another example of the stacking plate provided in the LCC.

FIG. 9 is a drawing illustrating another example of the stacking plate provided in the LCC 1. A stacking plate 211 has a rib 211B shaped to surround the section 41 and the screw 42 when the plate 211 is in the lower limit position. In other words, the rib 211B forms a depression 211C that includes an opening 211A as part of its bottom. The rib 211B is made of resin. The depression 211C is open upward and, when the plate 211 is in the locked state, accommodates the section 41 and the head of the screw 42 therewithin. Also, the rib 212B is formed in such a manner as to be flush with the head of the screw 42.

This prevents sheets of paper P stacked on the plate 21 from being pushed upward by the head of the screw 42 when the mechanism 40 fails to be removed, thereby allowing the sheets of paper P to be stacked stably. Also, auxiliary support provided to the stacked sheets of paper P by the head of the screw 42 allows the sheets of paper P to be stacked more stably on the plate 21.

Figure 10:
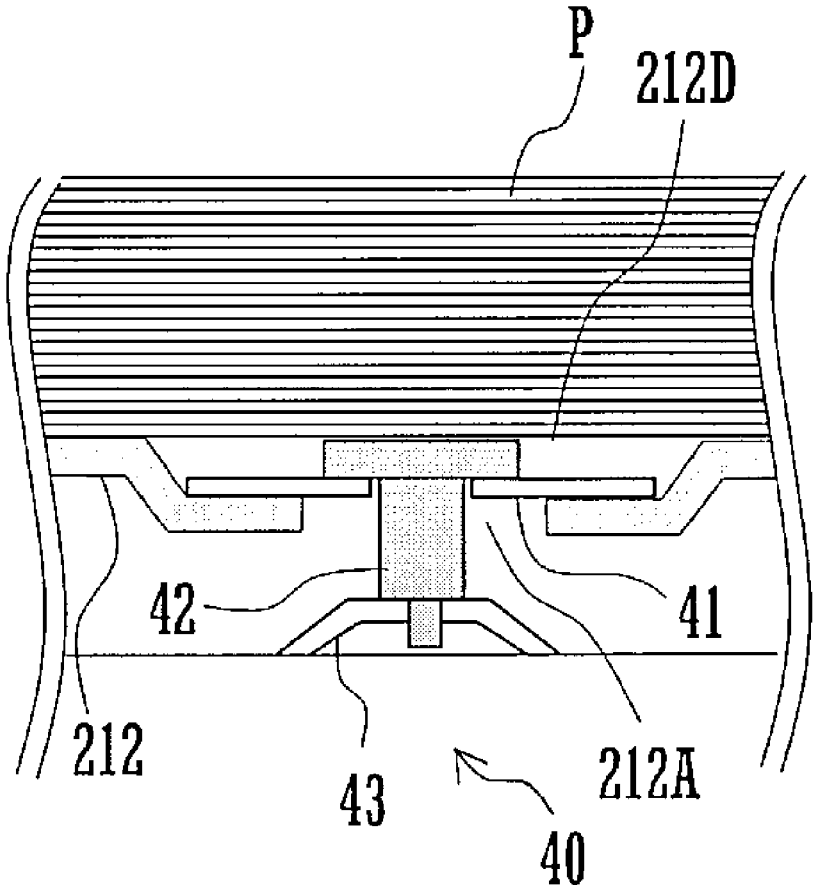
FIG. 10 is a drawing illustrating another example of the stacking plate provided in the LCC according to another embodiment of the invention.

FIG. 10 is a drawing illustrating another example of the stacking plate provided in the LCC 1. A stacking plate 212 has a depressed boss 212D. The boss 212D is open upward and, when the plate 211 is in the locked state, accommodates the section 41 and the head of the screw 42 therewithin. The boss 212D is formed in such a manner that the head of the screw 42 is flush with the plate 212.

This prevents sheets of paper P stacked on the plate 212 from being pushed up by the screw 42. It is not necessary that the head of the screw 42 is flush with the plate 212. If the head of the screw 42 is not flush with the plate 212, however, it is desirable that the boss 212D has a depth greater than the thickness of the head of the screw 42. This allows the sheets of paper P to be stacked in a horizontal position on the plate 212, even though the sheets are not supported on the head of the screw 42.

Figure 11:
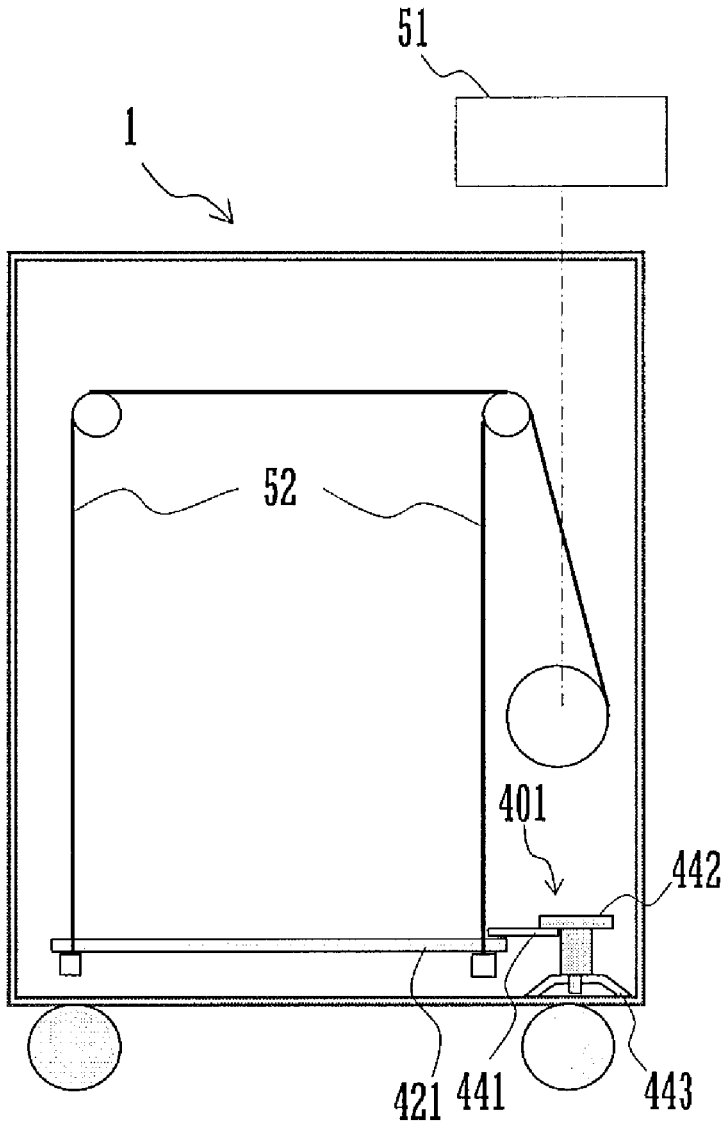
FIG. 11 is a cross-sectional view of another example of the moving member holding mechanism provided in the LCC.

FIG. 11 is a cross-sectional view of another example of the moving member holding mechanism provided in the LCC 1. A moving member holding mechanism 401, which is arranged outside an end of a stacking plate 421, has such a configuration as to lock the end of the plate 421 in the locked position. The mechanism 401 has a deformable section 441, a screw 442, and a plate member 443. The section 441 is attached to a lower side of the head of the screw 442. The screw 442 is fixed to the member 443. The section 441 is in contact with an upper side of the end of the plate 421 in the locked position. When the plate 421 is moved upward, the section 441 is released from the lower side of the head of the screw 442 to drop through a gap between the screw 442 and the plate 421.

Figure 12:
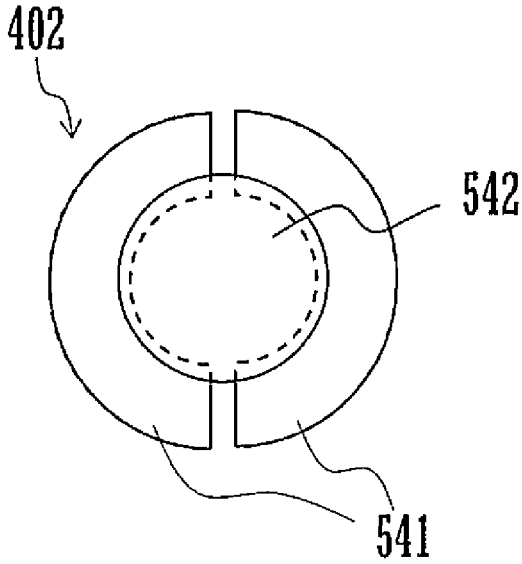
FIG. 12 is a top view of another example of the moving member holding mechanism provided in the LCC.

FIG. 12 is a top view of another example of the moving member holding mechanism provided in the LCC 1. A moving member holding mechanism 402 has a deformable section 542 that includes two semicircular plates 541.

Figure 13:
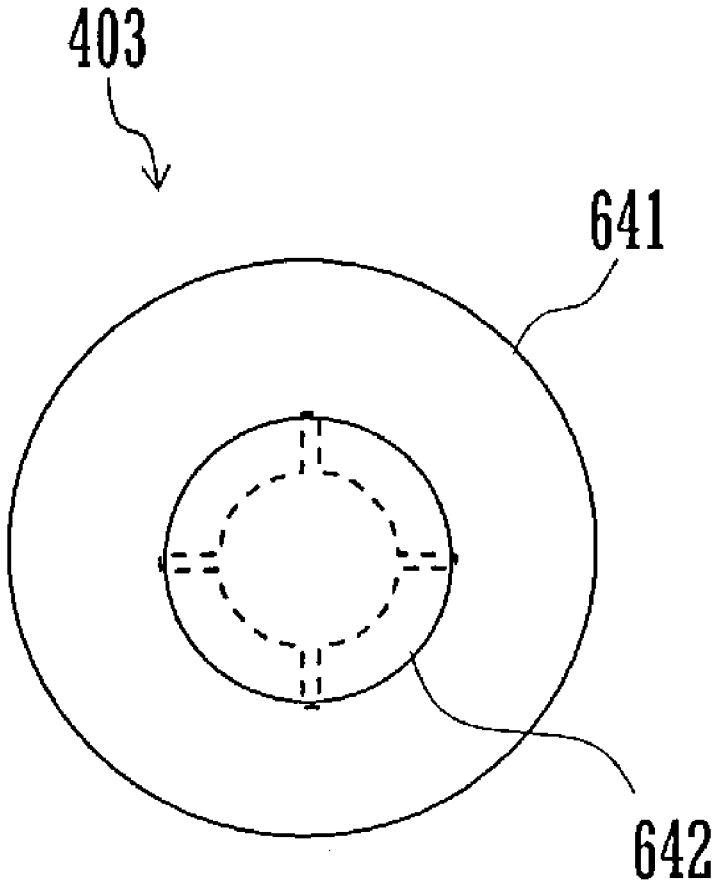
FIG. 13 is a top view of another example of the moving member holding mechanism provided in the LCC.

FIG. 13 is a top view of another example of the moving member holding mechanism provided in the LCC 1. A moving member holding mechanism 403 has a ring-shaped deformable section 641 made of elastic material. The section 641 has four cuts formed in an inner circumference of its ring. While being nipped between a screw 642 and a stacking plate, the section 641 holds the stacking plate in a locked position. When the stacking plate is moved upward, the section 641 becomes deformed, due to the four cuts and an elastic force, and lets the head of the screw 642 pass therethrough. Thus, the member 642 comes out of contact with the stacking plate.

Figure 14:
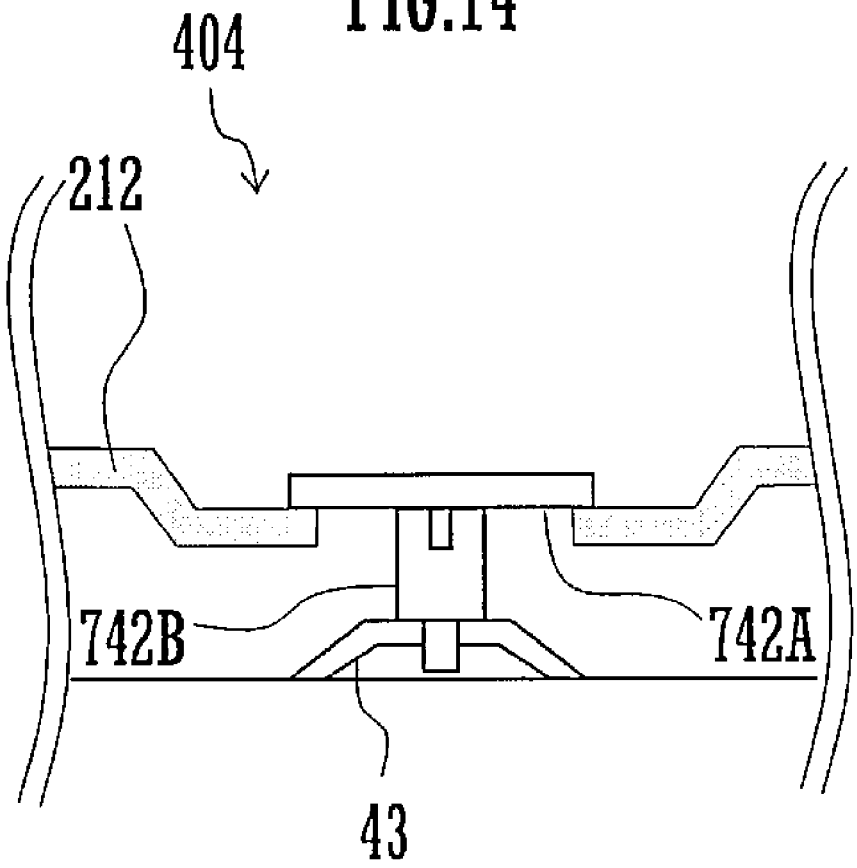
FIG. 14 is a drawing illustrating a state in which the stacking plate is locked by another example of the moving member holding mechanism provided in the LCC.
Figure 15:
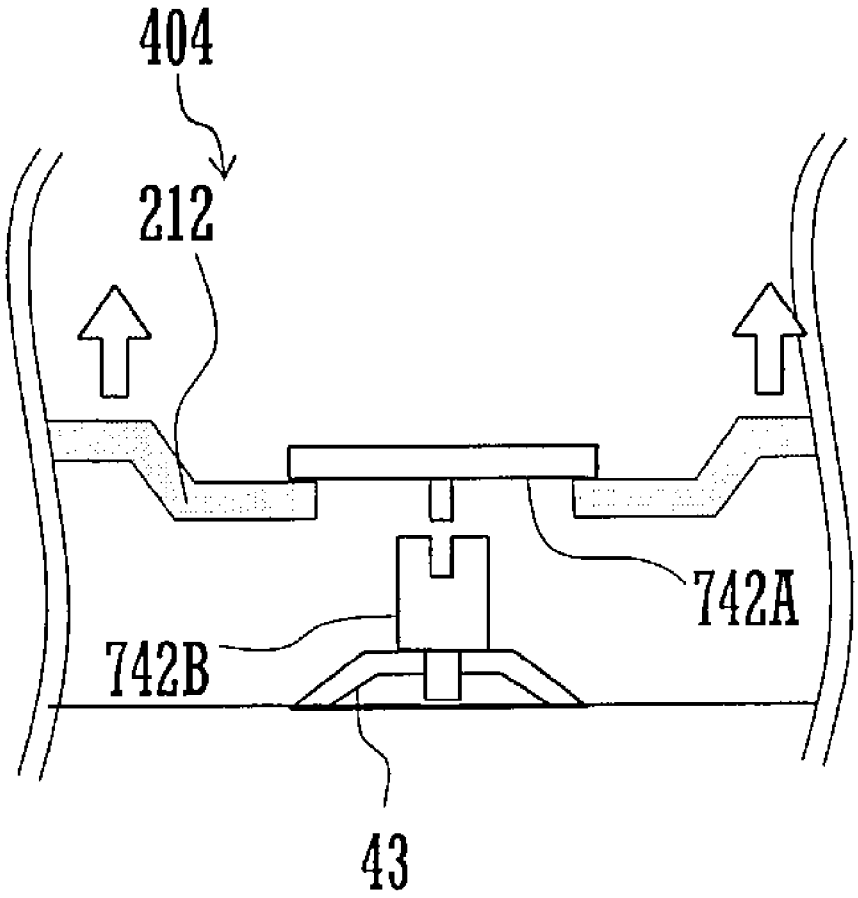
FIG. 15 is a drawing illustrating a state in which the stacking plate is unlocked from the moving member holding mechanism.

FIG. 14 is a drawing illustrating a state in which the stacking plate 212 is locked by another example of the moving member holding mechanism provided in the LCC 1. FIG. 15 is a drawing illustrating a state in which the stacking plate 212 is unlocked from the mechanism.

A moving member holding mechanism 404 has a deformable section that includes a head 742A and a shank 742B. The head 742A becomes detached from the shank 742B when the plate 212 is moved upward. Accordingly, the head 742A corresponds to the deformable section and the securing section of the Claims.

Figure 16:
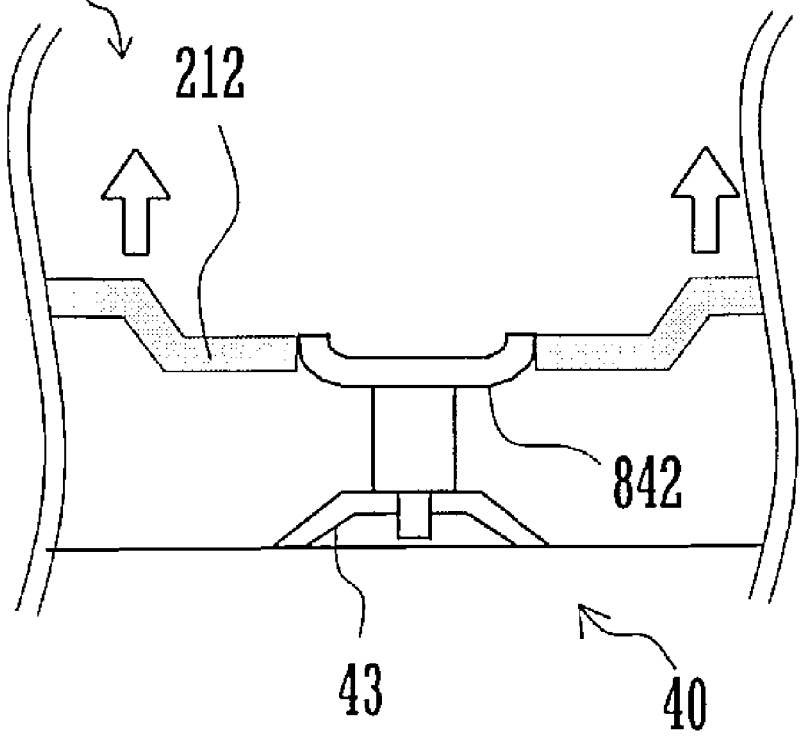
FIG. 16 is a drawing illustrating a state in which the stacking plate is unlocked from another example of the moving member holding mechanism provided in the LCC.

FIG. 16 is a drawing illustrating a state in which the stacking plate 212 is unlocked from another example of the moving member holding mechanism provided in the LCC 1. A moving member holding mechanism 405 has a screw 842 with its head made of elastic or plastic material. Thus, the mechanism 405 becomes elastically or plastically deformed when the plate 212 is moved upward. Accordingly, the head of the screw 842 corresponds to the deformable section and the securing section of the Claims.

As disclosed in the foregoing examples, the moving member holding mechanisms are desirably applied to a paper feeding device. The mechanisms are also applicable to other devices provided with moving members, such as image reading devices (scanners) to be described below.

Figure 17:
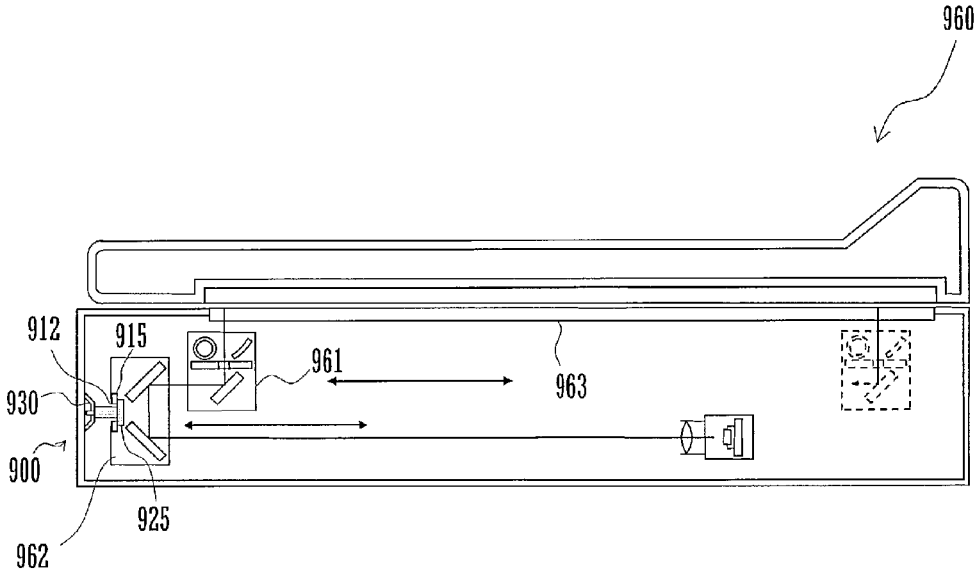
FIG. 17 is a cross-sectional view of an image reading device provided in the processing apparatus.

FIG. 17 is a cross-sectional view of an image reading device (scanner) 960. The scanner 960 has a first mirror base 961 and a second mirror base 962. Each of the bases 961 and 962 corresponds to the movable member of the Claims. The scanner 960 reads image information on an original document placed on an original platen 963.

The bases 961 and 962 are mounted below the platen 963 so as to be movable horizontally. The base 962 moves half as fast as the base 961. On the base 961, a light source and a first mirror are mounted. On the base 962, a second mirror and a third mirror are mounted.

The base 962 has an opening 912. The base 962 is prevented from being moved horizontally by a moving member holding mechanism 900 that is similar in configuration to those as described earlier. The mechanism 900 includes a deformable section 915 and a screw 925. Nipped between the screw 925 and the base 962, the section 915 is held in a locked position set on a left end of a movable range of the base 962. The screw 925 is passed through the opening 912 and fitted into a plate member 930 attached to a side wall of a casing of the device 960. Application of a driving force to move the base 962 brings the section 915 out of contact with the base 962, thereby allowing the base 962 to be freely moved horizontally.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A moving member holding mechanism comprising:

a moving member movable within a range, the moving member having a first surface facing a first end of the movable range and a second surface facing a second end of the movable range;

a driving device for driving the moving member; and a locking member for locking the moving member at the first end of the movable range by contact with the moving member, wherein:

the moving member has an opening that extends between the first and second surfaces;

the locking member has:

a supporting section fixed near the first end with a head turned to a side of the second end of the moveable range, and inserted in the opening of the moving member as locked at the first end of the moveable range;

a securing section attached to the head of the supporting section, and positioned nearer to the side of the second end of the moveable range than the moving member as locked at the first end of the moveable range; and a deformable section secured between the securing section and the moving member as locked at the first end of the moveable range, brought into contact with the second surface of the moving member as locked at the first end of the moveable range, and deformed by a driving force applied, through the moving member as locked at the first end of the moveable range, by the driving device; and the locking member is brought out of contact with the moving member as locked at the first end of the moveable range by the deformable section deformed by the driving force applied through the moving member as locked at the first end of the moveable range.

2. The moving member holding mechanism according to claim 1, wherein the deformable section is released from the securing section and retracted into the opening when the driving force is applied to the moving member as locked at the first end.

3. The moving member holding mechanism according to claim 1, wherein the moving member has a depression in a portion for contact with the deformable section, and the depression has a depth greater than thickness of the deformable section.

4. The moving member holding mechanism according to claim 1, wherein the moving member has a depression in a portion for contact with the deformable section, and the depression has a depth equal to thickness of the deformable section.

5. The moving member holding mechanism according to claim 1, wherein the opening is provided approximately in center of the moving member.

6. The moving member holding mechanism according to claim 1, wherein the deformable section is an elastic body.

7. A paper feeding device comprising:

a stacking plate for stacking sheets, the stacking plate being movable vertically between a lower limit position and a pick-up position, the stacking plate having a first surface facing the lower limit position and a second surface facing the pick-up position;

a driving device for driving the stacking plate;

a locking member for locking the stacking plate in the lower limit position by contact with the stacking plate; and a pick-up section for outputting sheets stacked on the stacking plate from the pick-up position, wherein:

the stacking plate has an opening that extends between the first and second surfaces, the locking member has:

a supporting section fixed near the lower limit position with a head turned to a side of the pick-up position, and inserted in the opening of the stacking plate as locked in the lower limit position;

a securing section attached to the head of the supporting section, and positioned nearer to the side of the pick-up position than the stacking plate as locked in the lower limit position; and a deformable section secured between the securing section and the stacking plate as locked in the lower limit position, contacted with the second surface of the stacking plate as locked in the lower limit position, and deformed by a driving force applied through the stacking plate as locked in the lower limit position; and the locking member is brought out of contact with the stacking plate as locked in the lower limit position by the deformable section deformed by the driving force applied through the moving member as locked in the lower limit position.

8. The paper feeding device according to claim 7, wherein the deformable section is released from the securing section and retracted into the opening when the driving force is applied to the stacking plate as locked in the lower limit position.

9. The paper feeding device according to claim 7, wherein the stacking plate has a depression in a portion for contact with the deformable section, and the depression has a depth greater than thickness of the deformable section.

10. The paper feeding device according to claim 7, wherein the stacking plate has a depression in a portion for contact with the deformable section, and the depression has a depth equal to thickness of the deformable section.

11. The paper feeding device according to claim 7, wherein the opening is provided approximately in center of the stacking plate.

12. The paper feeding device according to claim 7, wherein the deformable section is an elastic body.

* * * * *